US011517081B1

(12) United States Patent
Gorbunov et al.

(10) Patent No.: US 11,517,081 B1
(45) Date of Patent: Dec. 6, 2022

(54) WEARABLE DEVICE WITH SIMPLIFIED DISASSEMBLY

(71) Applicant: AURA Devices, Inc., Wilmington, DE (US)

(72) Inventors: Stanislav Gorbunov, Boston, MA (US); Yury Galtykhin, Quy Nhon (VN); Sergey Kalinin, Boston, MA (US); Dmitrii Nagornyi, Boston, MA (US)

(73) Assignee: AURA DEVICES, INC., Wilmington, DE (US)

( * ) Notice: Subject to any disclaimer, the term of this patent is extended or adjusted under 35 U.S.C. 154(b) by 0 days.

(21) Appl. No.: 17/830,498

(22) Filed: Jun. 2, 2022

(51) Int. Cl.
*A44C 5/14* (2006.01)

(52) U.S. Cl.
CPC ..... *A44C 5/145* (2013.01)

(58) Field of Classification Search
CPC ..... A44C 5/145
See application file for complete search history.

(56) References Cited

U.S. PATENT DOCUMENTS 5,283,933 A * 2/1994 Wiseman ..... A44B 11/2511 24/642
6,360,411 B1 * 3/2002 Bortz ..... G09F 3/0311 24/625
8,029,302 B1 * 10/2011 Duan ..... H01R 13/60 439/142
2010/0267276 A1 * 10/2010 Wu ..... H01R 25/003 439/502
2016/0078752 A1 * 3/2016 Vardi ..... H04B 1/385 340/506
2019/0361402 A1 * 11/2019 Markan ..... A44C 5/14

* cited by examiner

*Primary Examiner* — David M Upchurch
(74) *Attorney, Agent, or Firm* — Georgiy L. Khayet

(57) ABSTRACT

A wearable device is provided. The wearable device includes a housing. The housing includes a housing base, a housing hook extending from the housing base, and a locking pin extending from the housing base. The wearable device also includes a cover. The cover includes a cover base having an opening to receive the locking pin and a cover hook extending from the cover base. The cover hook is configured to engage the housing hook for latching the cover onto the housing. The wearable device also includes a strap. The strap includes a connector that has a through hole to receive the locking pin securing the strap to the housing and the cover when the housing and the cover are latched.

20 Claims, 4 Drawing Sheets

WEARABLE DEVICE WITH SIMPLIFIED DISASSEMBLY

TECHNICAL FIELD

This disclosure relates to wearable devices. More specifically, this disclosure relates to wearable devices with simplified disassembly.

BACKGROUND

People use wearable devices during various types of activities, such as walking, running, biking, playing sports, travelling, seating, working, and the like. Because wearable devices are widely used in different physical conditions, there is a risk that wearable devices can be damaged, and some components of the wearable devices may need to be replaced. To replace components of a conventional wearable device, a person that performs the replacement needs to open the wearable device, typically by disconnecting a housing from a cover of the wearable device using a special tool. This special tool can include a special-purpose key, or a screwdriver designed for disconnecting the cover from the housing of the wearable device. This may be inconvenient and require buying a special tool.

SUMMARY

This summary is provided to introduce a selection of concepts in a simplified form that are further described in the Detailed Description below. This summary is not intended to identify key features or essential features of the claimed subject matter, nor is it intended to be used as an aid in determining the scope of the claimed subject matter.

Generally, the present disclosure is directed to a technology for providing wearable devices with simplified disassembly. According to one example embodiment of the present disclosure, a wearable device is provided. The wearable device may include a housing. The housing may include a housing base, a housing hook extending from the housing base, and a locking pin extending from the housing base. The wearable device may also include a cover. The cover may include a cover base having an opening to receive the locking pin. The cover may further include a cover hook extending from the cover base. The cover hook may be configured to engage the housing hook for latching the cover onto the housing. The wearable device may also include a strap. The strap may include a connector that may have a through hole to receive the locking pin, thereby securing the strap to the housing and the cover when the housing and the cover are latched. When the housing and the cover are latched and the strap is bent from the housing base towards the cover base, the connector applies pressure on the cover base to cause the cover hook to disengage from the housing hook, thereby unlatching the housing from the cover.

According to another embodiment of the present disclosure, a method for manufacturing of a wearable device is provided. The method may commence with providing a housing. The housing may include a housing base, a housing hook extending from the housing base, and a locking pin extending from the housing base. The method may continue with providing a cover. The cover may include a cover base having an opening to receive the locking pin. The cover may further include a cover hook extending from the cover base. The cover hook may be configured to engage the housing hook for latching the cover onto the housing. The method may further include providing a strap. The strap may include a connector. The connector may include a through hole to receive the locking pin to secure the strap to the housing and the cover when the housing and the cover are latched. When the housing and the cover are latched and the strap is bent from the housing base towards the cover base, the connector applies pressure on the cover base to cause the cover hook to disengage from the housing hook, thereby unlatching the housing from the cover.

Other example embodiments of the disclosure and aspects will become apparent from the following description taken in conjunction with the following drawings.

BRIEF DESCRIPTION OF THE DRAWINGS

Embodiments are illustrated by way of example and not limitation in the figures of the accompanying drawings, in which like references indicate similar elements.

DETAILED DESCRIPTION

Figure 1:
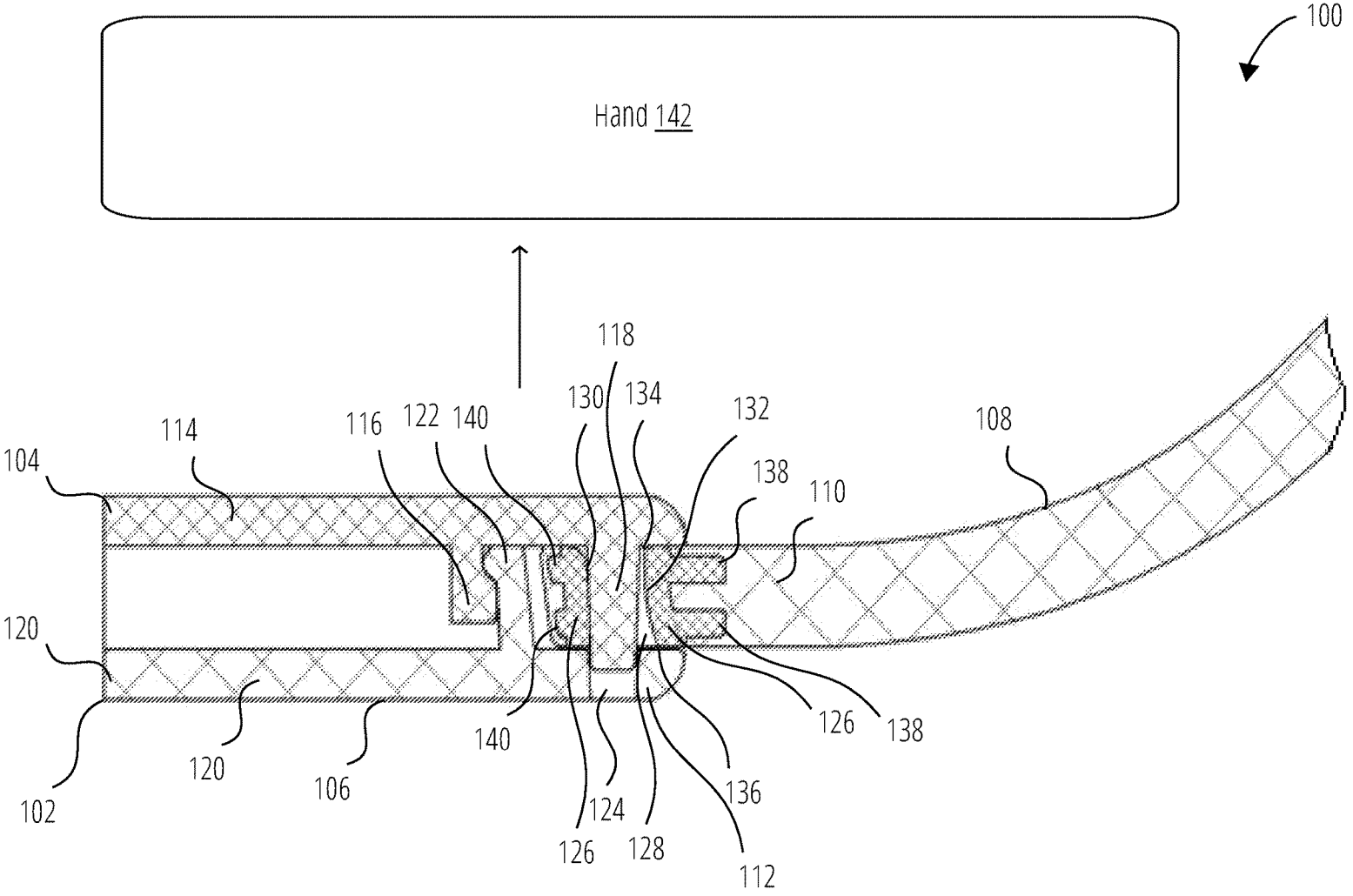
FIG. 1 illustrates a cross-sectional partial view of a wearable device assembled, according to an example embodiment.

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical, and operational changes can be made without departing from the scope of what is claimed. The following detailed description is, therefore, not to be taken in a limiting sense, and the scope is defined by the appended claims and their equivalents.

Generally, the embodiments of the present disclosure are concerned with wearable devices with simplified disassembly and methods for manufacturing of thereof. An example wearable device may include a housing, a cover, and a strap. The strap of the wearable device is used to disconnect the housing from the cover. More specifically, for the convenience of opening of the wearable device when replacing inner components of the wearable device, the strap of the wearable device can be used to disengage the cover from the housing. When the cover is disengaged from the housing, the strap is also disengaged from the wearable device. Therefore, unlike conventional wearable devices, the wearable device of the present disclosure allows eliminating the need to use a special tool for disconnecting the cover from the housing for purpose of replacing elements of the wearable device, such as a battery, sensors, strap, and so forth.

Referring now to the drawings, various embodiments are described in which like reference numerals represent like parts and assemblies throughout the several views. It should be noted that the reference to various embodiments does not limit the scope of the claims attached hereto. Additionally, any examples outlined in this specification are not intended to be limiting and merely set forth some of the many possible embodiments for the appended claims.

FIG. 1 is a cross-sectional partial view 100 of a wearable device 102 assembled, according to an example embodiment. The wearable device 102 may include a housing 104, a cover 106, and a strap 108. The strap 108 may have two ends and may be configured to connect by a first strap end 110 to a first end 112 of the wearable device 102 and connect by a second strap end (not shown) to a second end (not shown) of the wearable device 102. The position of strap 108 shown in FIG. 1 corresponds to the position of strap 108 while the wearable device 102 is being worn on a hand 142. When wearable device 102 is being worn on the hand 142, housing 104 touches skin of the hand 142 and strap 108 is bent around the wrist.

The housing 104 may include a housing base 114, a housing hook 116 extending from the housing base 114, and a locking pin 118 extending from the housing base 114. The cover 106 may include a cover base 120 and a cover hook 122. The cover base 120 may have an opening 124 designed to receive the locking pin 118. The cover hook 122 may extend from the cover base 120. The cover hook 122 may be configured to engage the housing hook 116 for latching the cover 106 onto the housing 104.

The strap 108 may include a connector 126. In an example embodiment, the strap 108 may have connector 126 both on the first strap end 110 and the second strap end. In another example embodiment, the strap 108 may have only one connector 126 inside either the first strap end 110 or the second strap end.

The connector 126 may have a through hole 128 to receive the locking pin 118 and thereby secure the strap 108 to the housing 104 and the cover 106 when the housing 104 and the cover 106 are latched.

In an example embodiment, the connector 126 may include a first wall 130 and a second wall 132. The first wall 130 and the second wall 132 may include walls of the through hole 128. When the housing 104 and the cover 106 are latched as shown in FIG. 1, the first wall 130 may touch the locking pin 118 along a direction from the housing base 114 towards the cover base 120. Furthermore, when the housing 104 and the cover 106 are latched as shown in FIG. 1, the second wall 132 may bend out from the locking pin 118 in a direction from the housing base 114 towards the cover base 120. The length of the second wall 132 may be larger than a distance between the cover base 120 and the housing base 114 when the cover 106 and the housing 104 are latched.

When the housing 104 and the cover 106 are latched, the second wall 132 may touch an angle 134 between the locking pin 118 and the housing base 114. Furthermore, when the housing 104 and the cover 106 are latched, the second wall 132 may touch a surface 136 of the cover base 120.

In an example embodiment, the connector 126 may include at least one lever 138. The at least one lever 138 may extend inside the strap 108 in a direction from the housing 104 towards the strap 108. When the housing 104 and the cover 106 are latched, the at least one lever 138 may be parallel to the housing base 114 and the cover base 120.

In an example embodiment, the connector 126 may include at least one leg 140. The at least one leg 140 may extend inside the strap 108 in a direction from the strap 108 towards the housing 104. When the housing 104 and the cover 106 are latched, the at least one leg 140 may be parallel to the housing base 114 and the cover base 120.

The at least one lever 138 and the at least one leg 140 may be used to provide a rigid placement of the connector 126 within the strap 108. Additionally, in an example embodiment, the connector 126 may be made from a material harder than a material of the rest of the strap 108. The harder material of the connector 126 may help the connector 126 to sit firmly in the strap 108 made of a less hard material both when the strap 108 does not move and when the strap 108 is bent.

Figure 2:
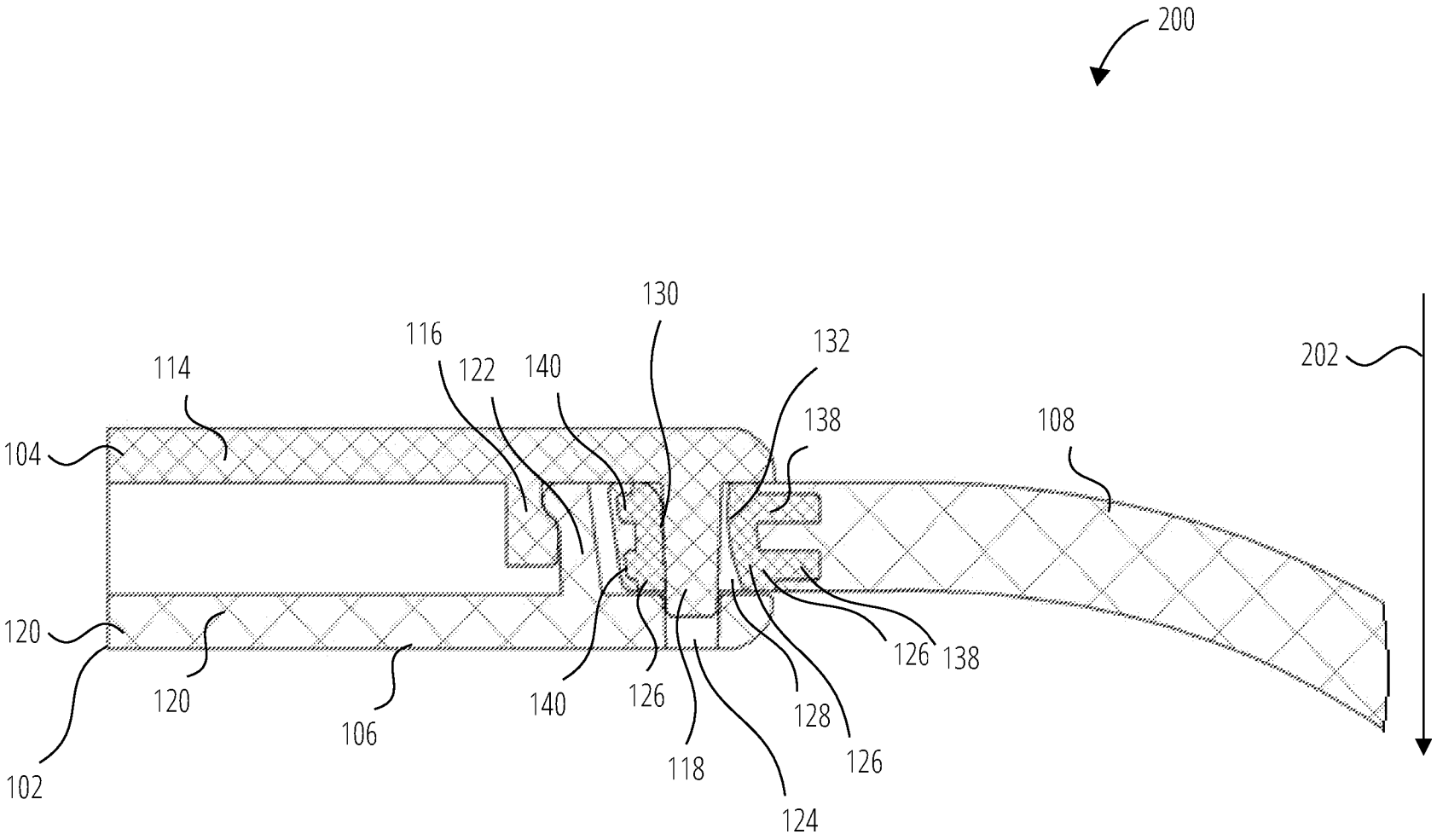
FIG. 2 illustrates a cross-sectional partial view of a wearable device in a position before opening of a cover of the wearable device, according to an example embodiment.

FIG. 2 illustrates a cross-sectional partial view 200 of a wearable device 102 in a position before opening of a cover 106 of the wearable device 102, according to an example embodiment. In the position shown in FIG. 2, the wearable device 102 is tightly closed, i.e., the cover 106 is connected tightly to the housing 104. To open the wearable device 102, the cover 106 needs to be detached from the housing 104 of the wearable device 102. To open the cover 106 (i.e., to detach the cover 106 from the housing 104), the strap 108 may be bent in a direction 202 from the housing base 114 to the cover base 120. The movement of the strap 108 in the direction 202 causes the movement of the connector 126 in the direction 202 to detach the cover 106 from the housing 104, as shown in FIG. 3.

Figure 3:
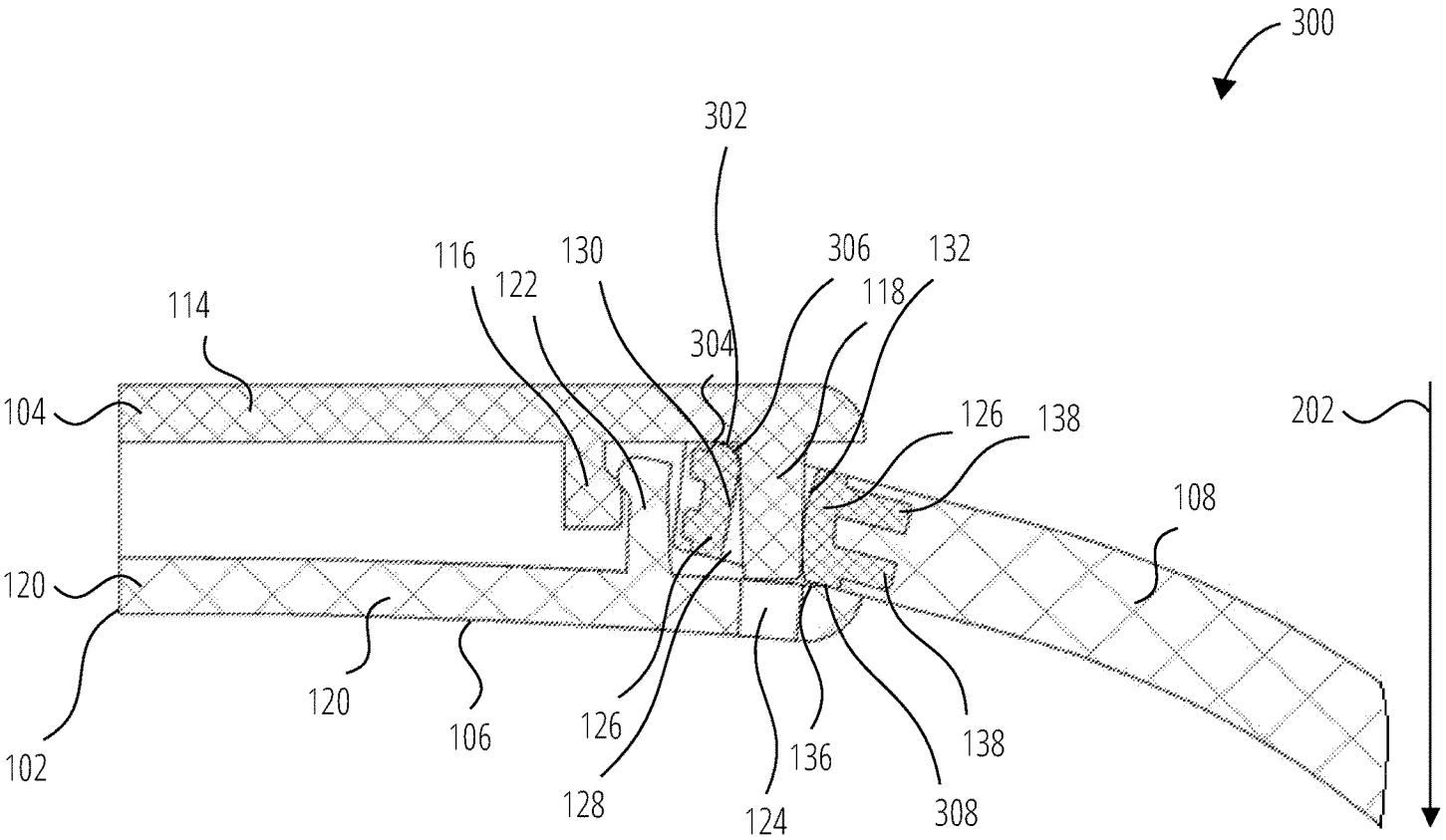
FIG. 3 illustrates a cross-sectional partial view of a wearable device at a moment of dismounting a cover of the wearable device, according to an example embodiment.

FIG. 3 illustrates a cross-sectional partial view 300 of a wearable device 102 at a moment of dismounting a cover 106 of the wearable device 102, according to an example embodiment. When the housing 104 and the cover 106 are latched and the strap 108 is bent in a direction 202 from the housing base 114 towards the cover base 120, the force applied to the strap 108 may be transferred through the connector 126 to the cover 106. In some embodiments, a user of the wearable device 102 may apply pressure at a spot above the lever 138. Upon bending of the strap 108 in the direction 202, the connector 126 may apply pressure on the cover base 120. The application of the pressure on the cover base 120 may cause the cover hook 122 to disengage from the housing hook 116, thereby unlatching the cover 106 from the housing 104.

Specifically, the connector 126 may have a first end face 302, which may contact a surface 304 of the housing base 114 before bending of the strap 108. The connector 126 may further have a curved surface 306 at a joining place of the first end face 302 and the first wall 130. When the strap 108 is bent in the direction 202 from the housing base 114 towards the cover base 120, the curved surface 306 may rotate with respect to the locking pin 118 and may cause the first end face 302 of the connector 126 to lean against the surface 304 of the housing base 114 of the housing 104.

The connector 126 may further have a second end face 308, which may contact the surface 136 of the cover base 120 of the cover 106. When the first end face 302 of the connector 126 leans against the surface 304 of the housing base 114 of the housing 104, the second end face 308 may press against the surface 136 of the cover base 120. The pressure applied by the second end face 308 of the connector 126 on the cover base 120 of the cover 106 may cause the cover hook 122 of the cover 106 to disengage from the housing hook 116 of the housing 104.

The application of the pressure by the connector 126 on the cover base 120 may further cause the locking pin 118 of the housing 104 to go out from the opening 124 of the cover 106. This may result in detaching the cover 106 from the housing 104, thereby allowing access to an internal space and components of the wearable device 102. Upon detaching the cover 106 from the housing 104, the strap 108 can be detached from the housing 104 by taking the connector 126 off the locking pin 118 thereby allowing replacing the strap 108 if needed.

Figure 4:
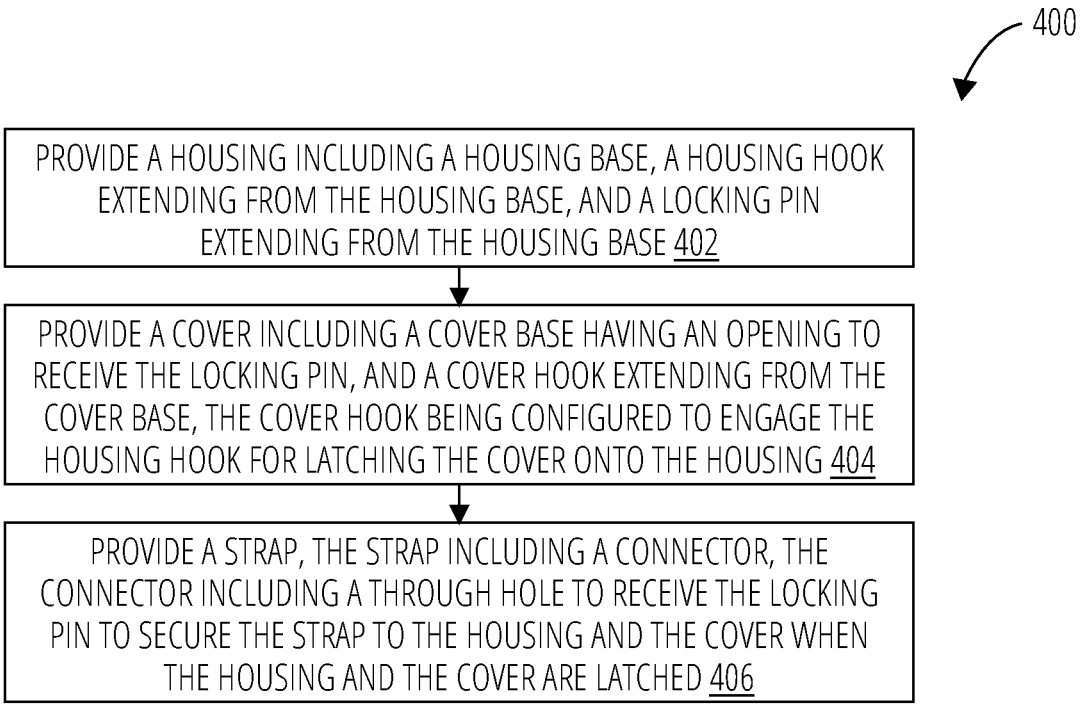
FIG. 4 is a flow chart illustrating a method for manufacturing of a wearable device, according to an example embodiment.

FIG. 4 is a flow chart of a method 400 for manufacturing of a wearable device, according to an example embodiment. In some embodiments, the operations may be combined, performed in parallel, or performed in a different order. The method 400 may also include additional or fewer operations than those illustrated.

In block 402, the method 400 may commence with providing a housing. The housing may include a housing base, a housing hook extending from the housing base, and a locking pin extending from the housing base. In block 404, the method 400 may continue with providing a cover. The cover may include a cover base having an opening to receive the locking pin. The cover may further include a cover hook extending from the cover base. The cover hook may be configured to engage the housing hook for latching the cover onto the housing. In block 406, the method 400 may include providing a strap. The strap may include a connector. The connector may include a through hole to receive the locking pin to secure the strap to the housing and the cover when the housing and the cover are latched. When the housing and the cover are latched and the strap is bent in a direction from housing base towards the cover base, the connector may be configured to apply pressure on the cover base to cause the cover hook to disengage from the housing hook and, thereby, unlatch the housing from the cover.

The connector may include a first wall and a second wall. When the housing and the cover are latched, the first wall may touch the locking pin along a direction from the housing base towards the cover base. Moreover, the second wall may bend out from the locking pin in a direction from the housing base towards the cover base. The length of the second wall may be larger than a distance between the cover base and the housing base when the cover and housing are latched. When the housing and the cover are latched, the second wall may touch an angle between the locking pin and the housing base. Moreover, when the housing and the cover are latched, the second wall may touch a surface of the cover base.

In an example embodiment, the connector may be made of a material harder than a material of the rest of the strap. The connector may include at least one lever extending inside the strap in a direction from the housing to the strap. When the housing and the cover are latched, the at least one lever may be parallel to the housing base and the cover base. The connector may further include at least one leg extending inside the strap in a direction from the strap to the housing. When the housing and the cover are latched, the at least one leg may be parallel to the housing base and the cover base.

Thus, wearable devices with simplified disassembly and methods for manufacturing of thereof are disclosed. While the present embodiments have been described in connection with a series of embodiments, these descriptions are not intended to limit the scope of the subject matter to the particular forms set forth herein. It will be further understood that the wearable devices and methods are not necessarily limited to the discrete components described. To the contrary, the present descriptions are intended to cover such alternatives, modifications, and equivalents as may be included within the spirit and scope of the subject matter as disclosed herein and defined by the appended claims and otherwise appreciated by one of ordinary skill in the art.

What is claimed is:

1. A wearable device comprising:

a housing including:

a housing base;

a housing hook extending from the housing base; and a locking pin extending from the housing base;

a cover including:

a cover base having an opening to receive the locking pin; and a cover hook extending from the cover base, the cover hook being configured to engage the housing hook for latching the cover onto the housing; and a strap including a connector having a through hole to receive the locking pin securing the strap to the housing and the cover when the housing and the cover are latched.

2. The wearable device of claim 1, wherein when the housing and the cover are latched and the strap is bent from the housing base towards the cover base, the connector is configured to apply pressure on the cover base to cause the cover hook to disengage from the housing hook, thereby unlatching the housing from the cover.

3. The wearable device of claim 1, wherein the connector includes a first wall and a second wall, wherein when the housing and the cover are latched:

the first wall touches the locking pin along a direction from the housing base towards the cover base; and the second wall bends out from the locking pin in a direction from the housing base towards the cover base.

4. The wearable device of claim 3, wherein a length of the second wall is larger than a distance between the cover base and the housing base when the cover and the housing are latched.

5. The wearable device of claim 3, wherein when the housing and the cover are latched, the second wall touches an angle between the locking pin and the housing base.

6. The wearable device of claim 3, wherein when the housing and the cover are latched, the second wall touches a surface of the cover base.

7. The wearable device of claim 1, wherein the connector is made from a material harder than a material of the rest of the strap.

8. The wearable device of claim 1, wherein the connector includes at least one lever extending inside the strap in a direction from the housing to the strap.

9. The wearable device of claim 8, wherein when the housing and the cover are latched, the at least one lever is parallel to the housing base and the cover base.

10. The wearable device of claim 1, wherein the connector includes at least one leg extending inside the strap in a direction from the strap to the housing.

11. A method for manufacturing of a wearable device, the method comprising:

providing a housing including:

a housing base;

a housing hook extending from the housing base; and a locking pin extending from the housing base;

providing a cover including:

a cover base having an opening to receive the locking pin; and a cover hook extending from the cover base, the cover hook being configured to engage the housing hook for latching the cover onto the housing; and providing a strap, the strap including a connector, the connector including a through hole to receive the locking pin to secure the strap to the housing and the cover when the housing and the cover are latched.

12. The method of claim 11, wherein when the housing and the cover are latched and the strap is bent in a direction from the housing base towards the cover base, the connector is configured to apply pressure on the cover base to cause the cover hook to disengage from the housing hook and, thereby, unlatch the housing from the cover.

13. The method of claim 11, wherein the connector includes a first wall and a second wall, wherein when the housing and the cover are latched:

the first wall touches the locking pin along a direction from the housing base towards the cover base; and the second wall bends out from the locking pin in a direction from the housing base towards the cover base.

14. The method of claim 11, wherein a length of the second wall is larger than a distance between the cover base and the housing base when the cover and the housing are latched.

15. The method of claim 11, wherein when the housing and the cover are latched, the second wall touches an angle between the locking pin and the housing base.

16. The method of claim 11, wherein when the housing and the cover are latched, the second wall touches a surface of the cover base.

17. The method of claim 11, wherein the connector is made from a material harder than a material of the rest of the strap.

18. The method of claim 11, wherein the connector includes at least one lever extending inside the strap in a direction from the housing to the strap.

19. The method of claim 18, wherein when the housing and the cover are latched, the at least one lever is parallel to the housing base and the cover base.

20. The method of claim 11, wherein the connector includes at least one leg extending inside the strap in a direction from the strap to the housing.

* * * * *